United States Patent [19]

Knief

[11] Patent Number: 4,786,185

[45] Date of Patent: Nov. 22, 1988

[54] APPARATUS AND METHOD FOR AFFECTING THE FLOW PATHS OF FLUID FLOWING IN A PIPE

[75] Inventor: Chester L. Knief, Bartlesville, Okla.

[73] Assignee: Phillips Petroleum Company, Bartlesville, Okla.

[21] Appl. No.: 161,829

[22] Filed: Feb. 29, 1988

[51] Int. Cl.[4] ..... B01F 5/06

[52] U.S. Cl. ..... 366/340; 261/108

[58] Field of Search ..... 366/336, 337, 338, 340; 138/37, 38, 42; 48/189.4; 261/108, 113

[56] References Cited

U.S. PATENT DOCUMENTS

| | | | |
|---|---|---|---|
| 96,585 | 11/1869 | Hale . | |
| 1,519,371 | 12/1924 | Farnsworth . | |
| 3,490,655 | 1/1970 | Ledgett | 222/196 |
| 3,582,048 | 6/1971 | Sarem | 366/340 |
| 4,159,881 | 7/1979 | Gogneau | 366/337 |
| 4,207,009 | 6/1980 | Glocker | 366/340 |
| 4,344,844 | 8/1982 | Townley | 366/340 |
| 4,418,717 | 12/1983 | Pauliukonis | 137/614.2 |
| 4,606,138 | 8/1986 | Gentry | 34/182 |
| 4,696,734 | 9/1987 | Gentry | 208/407 |

*Primary Examiner*—Robert W. Jenkins
*Attorney, Agent, or Firm*—William R. Sharp

[57] ABSTRACT

An apparatus and method are provided which achieve an advantageous effect on the flow paths of fluid flowing in a pipe, wherein such an effect makes the apparatus and method particularly useful for mixing fluids. In accordance with the invention, fluid is flowed through an apparatus which includes a pipe member comprising a first tubular portion and a second tubular portion which outwardly extends from the first portion so as to be in communication with the interior of the first portion. A plate having apertures through which fluid flows is positioned in the first tubular portion so as to extend into the second tubular portion.

20 Claims, 4 Drawing Sheets

APPARATUS AND METHOD FOR AFFECTING THE FLOW PATHS OF FLUID FLOWING IN A PIPE

BACKGROUND OF THE INVENTION

This invention relates to an apparatus and method for achieving an advantageous affect on the flow paths of fluid flow in a pipe. The invention is particularly useful for effective static mixing of a plurality of fluids flowing in a pipe. As used herein, the term "Static Mixer" refers to a mixer which requires no moving parts to cause the mixing effect.

Prior Static Mixers typically employ a large number of baffles mounted within a fluid flow receiving pipeline. These mixers are particularly ineffective in mixing volumes of fluid which are longitudinally separated from one another in the pipeline. This problem sometimes occurs in the environment of refineries, for example, which utilize static mixers to mix various combustible gases from different sources (i.e. from fuel gas pipelines, waste gases from other processes, etc.) for the purpose of combusting such a mixture in steam boilers and furnaces. Because of varying flow rates from the gas sources and/or because of injection of the different gases into the pipeline at longitudinally separated locations, "slugs" or volumes of different, relatively unmixed gases can become widely separated longitudinally in the pipeline, thereby causing the possibility of a potentially hazardous, wildly fluctuating flame in the burner of the furnace or boiler due to different heating values of the gases. The problem of a fluctuating flame due to ineffective mixing of the combustible gases can also occur in an incinerator.

Furthermore, prior Static Mixers as described above can be extremely noisy due to the turbulence created by the baffles, and even more importantly, the baffles in such mixers cause a significant head loss and consequent decrease in flow rate.

SUMMARY OF THE INVENTION

It is, therefore, an object of the invention to provide an apparatus and method capable of effectively mixing different fluids flowing in a pipeline, particularly with respect to the situation where volumes or slugs of different fluids are longitudinally separated from one another in the pipeline.

It is also an object of the invention to provide an apparatus and method capable of mixing fluids which generates a minimal amount of noise.

It is a further object of the invention to provide an apparatus and method capable of mixing fluids which will not substantially affect the flow rate of fluids flowing in a pipeline after mixing thereof.

The above objects are realized by an apparatus which includes a pipe member which comprises a first tubular portion and a second tubular portion, where the first tubular portion has a wall with an opening therethrough, and where the second tubular portion has an open end and a closed end axially opposite (with respect to the second portion longitudinal axis) the open end. The second portion is connected to the wall of the first portion at the open end so as to outwardly extend from the wall to the closed end of the second portion, and so that the open end is in communication with the interior of the first portion through the wall opening. The apparatus further includes: a means for introducing a fluid into the first portion so as to establish a flow of fluid therein in a direction generally parallel to the first portion longitudinal axis and generally toward the second portion longitudinal axis; and a plate having opposing surfaces and a plurality of apertures which open through such surfaces so as to be disposed within both of the tubular portions. The plate is positioned in the pipe member so as to extend from a first end, which is positioned adjacent to the first portion interior surface at a location axially opposite (with respect to the second portion longitudinal axis) the closed end of the second portion, to a second end which is adjacent to the interior surface of the second portion at its closed end. The plate further extends across the pipe member so as to cross the first portion longitudinal axis. Finally, the plate is oriented such that one of the plate surfaces face generally in the same direction as the fluid flow direction, and such that the other plate surface faces generally in a direction opposite to the fluid flow direction.

According to another aspect of the invention, a method of using the apparatus as generally described above is provided, wherein the plate can be considered to divide the pipe member into an upstream chamber and a downstream chamber. The method comprises: passing fluid through the first tubular portion in a direction generally parallel to its longitudinal axis; and flowing the fluid toward the plate so as to flow adjacent to the surface of the plate which generally faces the upstream chamber so that some of the fluid passes through apertures, which are positioned within the first portion, to the downstream chamber, whereas other fluid is directed along the upstream facing surface so as to flow into the second portion and through apertures positioned therein to the downstream chamber so as to be directed by the second portion back into the first portion.

The operation of the apparatus as described above effectively mixes a plurality of different fluids which are flowed through the apparatus, and most importantly effectively mixes volumes of different fluids which are widely (i.e. by 20 to 30 ft.) separated longitudinally within the pipe member. Such effective mixing results from the fact that particular volumes of fluid impinges upon the plate so that some fluid flows into the second portion before passing through apertures in the plate. This lengthens flow paths so as to disperse a volume of fluid over a longer length, thereby resulting in uniform mixing of longitudinally separated volumes of fluid. Additionally, operation of the inventive apparatus produces little or no noise due to the minimal fluid turbulence generated within the pipe member. Furthermore, operation of the apparatus has a minimal effect on the flow rate of fluid passing therethrough. As will be discussed further below, the ratio of total aperture flow area to first tubular portion cross-sectional flow area can be adjusted to optimally minimize the effect on fluid flow rate.

As will also be discussed further below, the invention has applications other than fluid mixing, due to the previously discussed effect on fluid flow paths.

DETAILED DESCRIPTION OF THE INVENTION

Embodiments of the invention will now be described with reference to the FIGURES. Although the invention will be described in terms of fluid mixing, it should be understood that an apparatus in accordance with the invention could also be used, for example, to receive a fluid therethrough for the purpose of smoothing out fluid pulsations (i.e. a muffler). This desired effect is achieved by the dispersal of a volume of fluid over a longer length due to the breaking up of the fluid flow into a plurality of flow paths having different flow distances associated therewith.

Figure 1:
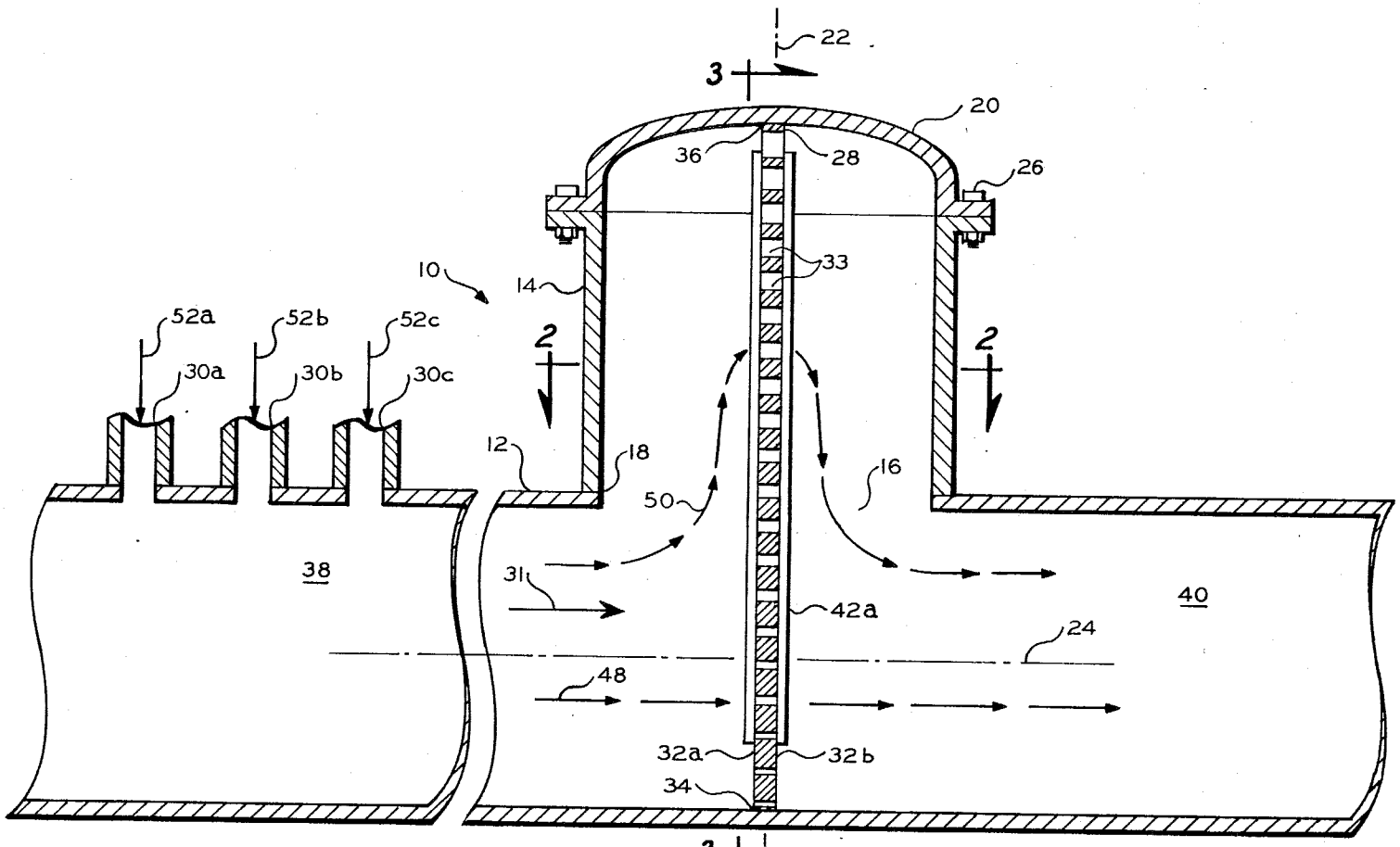
FIG. 1 is a cross-sectional view of one embodiment of an apparatus in accordance with the invention.

Referring now to FIG. 1, the illustrated apparatus includes a pipe member 10 which comprises a first tubular portion 12 and a second tubular portion 14, wherein each of the tubular portions has a respective interior surface which together comprises the interior surface of pipe member 10. It should be understood that the illustrated apparatus is not necessarily shown to scale. For example, the length of tubular portion 14 is preferably about 10 to about 30 times the diameter of tubular portion 12. Tubular portion 12 comprises a wall with an opening 16 therethrough which communicates with open end 18 of tubular portion 14. Tubular portion 14 is connected to the wall of tubular portion 12 at open end 18 so as to outwardly extend from the wall to closed end 20 of tubular portion 14, which is axially opposite open end 18 with respect to longitudinal axis 22 of tubular portion 14, and further such that open end 18 is in communication with the interior of tubular portion 12 through opening 16. In the illustrated embodiment, the tubular portions are oriented with respect to one another such that longitudinal axis 22 of tubular portion 14 is generally perpendicular to longitudinal axis 24 of tubular portion 12. In addition, it is preferable that closed end 20 comprise a removable cap which can be removed by means of bolts 26. Removing closed end or cap 20 permits easy and convenient removal and replacement of plate 28, which is positioned in pipe member 10 in a manner discussed further below.

Pipe member 10 also has associated therewith pipe member inlets 30*a*, 30*b* and 30*c* which communicate with the interior of tubular portion 12 and which are longitudinally separated from one another with respect to longitudinal axis 24. As will be discussed further below in connection with the operation of the apparatus, each inlet corresponds to a particular fluid which is passed therethrough for introduction into pipe member 10 so as to establish a flow of fluid within tubular portion 12 in a direction, as indicated at 31, generally parallel to longitudinal axis 24 and generally toward longitudinal axis 22.

Plate 28 has opposing, and preferably planar and parallel surfaces 32*a* and 32*b*, which are also preferably generally perpendicular to longitudinal axis 24. A plurality of apertures as indicated at 33, later discussed in more detail, open through the plate surfaces so that, as shown, some of the apertures are positioned within tubular portion 12 whereas the remainder of the apertures are positioned within tubular portion 14. Plate 28 is preferably oriented so that it extends generally along longitudinal axis 22 from lower end 34, which as shown is closely adjacent to and preferably contacts the interior surface of tubular portion 12 at a location axially opposite (with respect to longitudinal axis 22) closed end 20, to upper end 36 which is closely adjacent to and preferably contacts the interior surface of tubular portion 14 at closed end 20. Although the illustrated apparatus is oriented such that ends 34 and 36 can be described as lower and upper respectively, it should be understood that the apparatus need not be oriented in such a manner to successfully operate where gases are employed as the fluids. In addition, plate 28 extends across pipe member 10 so as to cross longitudinal axis 24 and such that plate surface 32*b* faces generally in the same direction as fluid flow direction 31 and plate surface 32*a* faces generally in a direction opposite to fluid flow direction 31.

Therefore, it should be apparent from FIG. 1 and from the above description that plate 28 generally divides pipe member 10 into an upstream chamber 38 and a downstream chamber 40.

Plate 28 is preferably slidably and removably mounted within pipe member 10 in a manner described immediately below in order to permit the easy, convenient removal and possible replacement of plate 28. Such mounting of plate 28 is provided by elongated member 42*a*, and another elongated member (not shown in FIG. 1) on the opposite side of pipe member 10. Each elongated member is fixedly mounted to the interior surface of pipe member 10 so as to be generally parallel to longitudinal axis 22, and is configured so as to define a channel which slidably and removably receives plate 28 therein as shown. Thus, plate 28 can be removed from pipe member 10 by merely removing closed end or cap 20, and then physically withdrawing plate 28 from pipe member 10 with an upward motion so as to slide the plate out of the channels defined by the elongated plate receiving members. After removal of the plate, a replacement plate, with a different arrangement of apertures for example, can then be slidably inserted into the elongated members' channels with a downward motion. Such replacement might be desirable when changing upstream flow rates, for example, and/or in a trial and error effort to achieve a desired flow rate and mixing effect on the downstream side of the plate.

Figure 2:
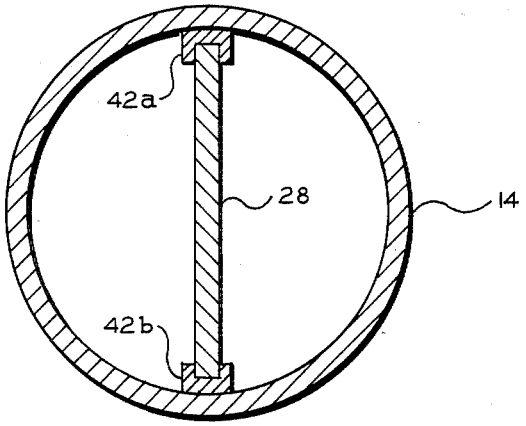
FIG. 2 is a cross-sectional view of the apparatus of FIG. 1 as viewed along lines 2—2.

Referring now to FIG. 2, there is shown a cross-sectional view of a portion of the apparatus of FIG. 1. Illustrated are tubular portion 14, plate 28, elongated member 42*a*, and the other elongated member 42*b* which is positioned on the opposite side of tubular portion 14. FIG. 2 clearly illustrates the configuration of each of the elongated members and the manner in which channels defined thereby slidably receive plate 28.

Figure 3:
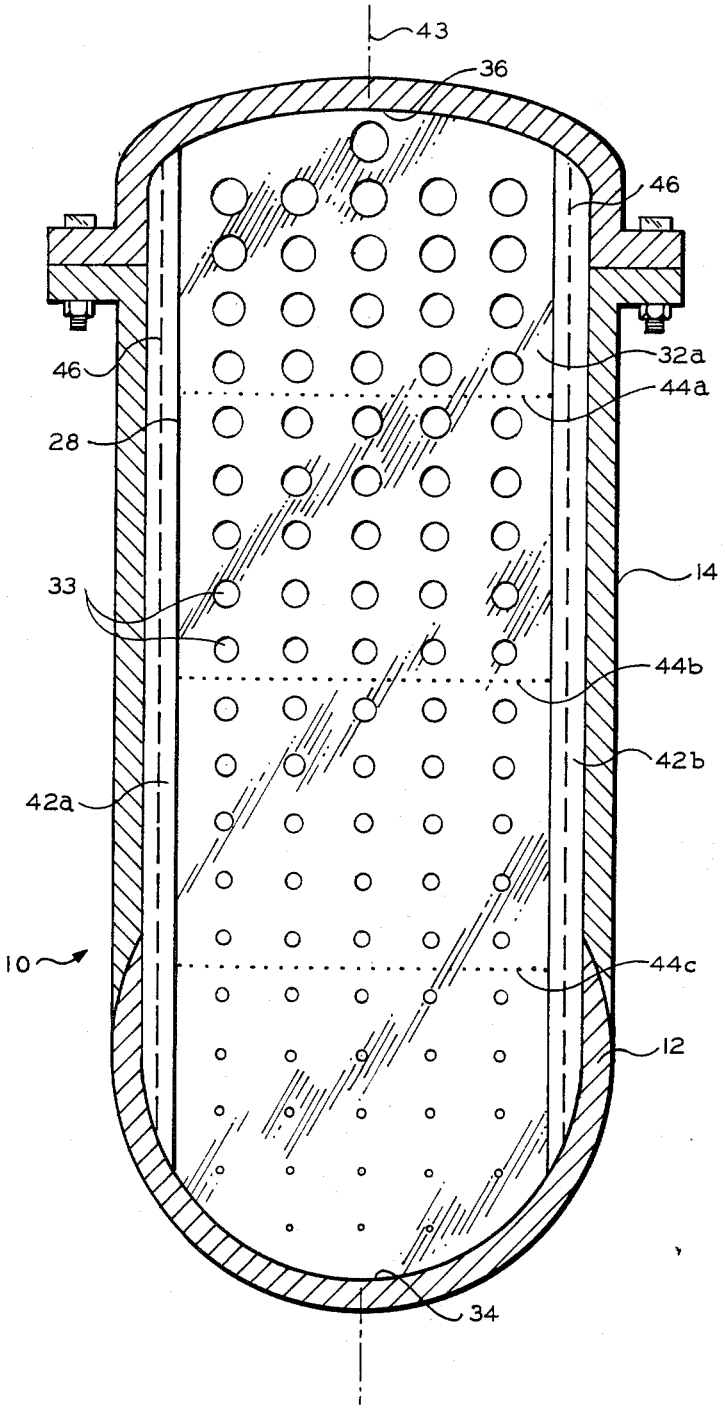
FIG. 3 is a cross-sectional view of the apparatus of FIG. 1 as viewed along lines 3—3.

Referring now to FIG. 3, there is shown another cross-sectional view of the apparatus of FIG. 1 which clearly shows the arrangement of apertures 33. Firstly, plate 28 has a longitudinal axis 43 which intersects ends 34 and 36, and which in the illustrated embodiment happens to be coincident with the longitudinal axis of tubular portion 14. Generally speaking, the apertures are preferably arranged and sized such that for a surface of the plate divided into longitudinal separated (with respect to longitudinal axis 43) sections of approximately equal surface area where each section includes at least one aperture, each section has associated therewith a certain aperture flow area per unit surface area (i.e. which could be expressed as number of square inches of aperture flow area per square inch of surface area) which for the various sections generally progressively increases from lower end 34 to upper end 36. Such longitudinally separated sections are indicated, by way of example, in FIG. 3, wherein imaginary boundaries for such sections are represented by dotted lines 44*a–c*.

In the particular embodiment illustrated in FIG. 3, the apertures are generally equidistantly spaced and the flow area of individual apertures generally progressively increases from lower end 34 to upper end 36. Another embodiment will be discussed with regard to FIG. 4.

As used herein, aperture flow area for a particular section is the sum of the individual flow areas for each aperture in that section. Therefore, the aperture flow area per unit surface area for a particular section is found by determining the aperture flow area for the section, which is divided by the surface area of the section. The terms "aperture" and "flow area" should be readily apparent to those skilled in the art. Nevertheless, the term "aperture" as used herein can be defined as a passage through the plate. The "flow area" of an aperture can be defined as the cross-sectional area of the aperture at its narrowest point, or stated another way, at the point of greatest constriction. In the illustrated embodiment, each of the apertures 33 has a uniform cross-section through the length thereof so that the flow area of each aperture can be said to simply be equal to the cross-sectional area thereof.

The above-discussed feature of the invention wherein the aperture flow area per unit surface area generally increases from lower end 34 to upper end 36 is advantageous insofar as this encourages flow through the portion of plate 28 which is contained in tubular portion 14. Of course, fluid flowing through pipe member 10 will have a tendency to flow straight through plate 28 rather than flowing upward into tubular portion 14 and through the plate. Most preferably, the apertures are arranged and sized such that the flow rate of fluid flowing out of the apertures is substantially uniform from lower end 34 to upper end 36.

It is also preferable that the total flow area of the apertures 33 (sum of the flow areas for all of the apertures) is at least equal to the cross-sectional area of tubular portion 12 in order to minimize the effect on the fluid flow rate of fluid passing from upstream chamber 38 to downstream chamber 40. Most preferably, the ratio of total aperture flow area to tubular portion 12 cross-sectional area is about 2:1 so as to optimally minimize the effect on fluid flow rate. It should be apparent to one skilled in the art that the flow rate across the plate will necessarily decrease somewhat due to impingement of fluid against the plate and due to directional changes of the fluid in flowing between tubular portions 12 and 14. Thus, providing a sufficiently large ratio ensures a minimum effect on flow rate.

Finally with respect to FIG. 3, it can be seen that the edge, which connects opposing surfaces 32*a* and 32*b*, of plate 28 is closely adjacent to the interior surface of pipe member 10 around its entire perimeter, and in the illustrated embodiment contacts the interior surface at lower end 34 and upper end 36 as previously mentioned. Dashed lines shown at 46 indicate the portions of the plate edge which fit snugly but slidably against the inwardly facing surfaces of elongated members 42*a* and 42*b*.

Figure 4:
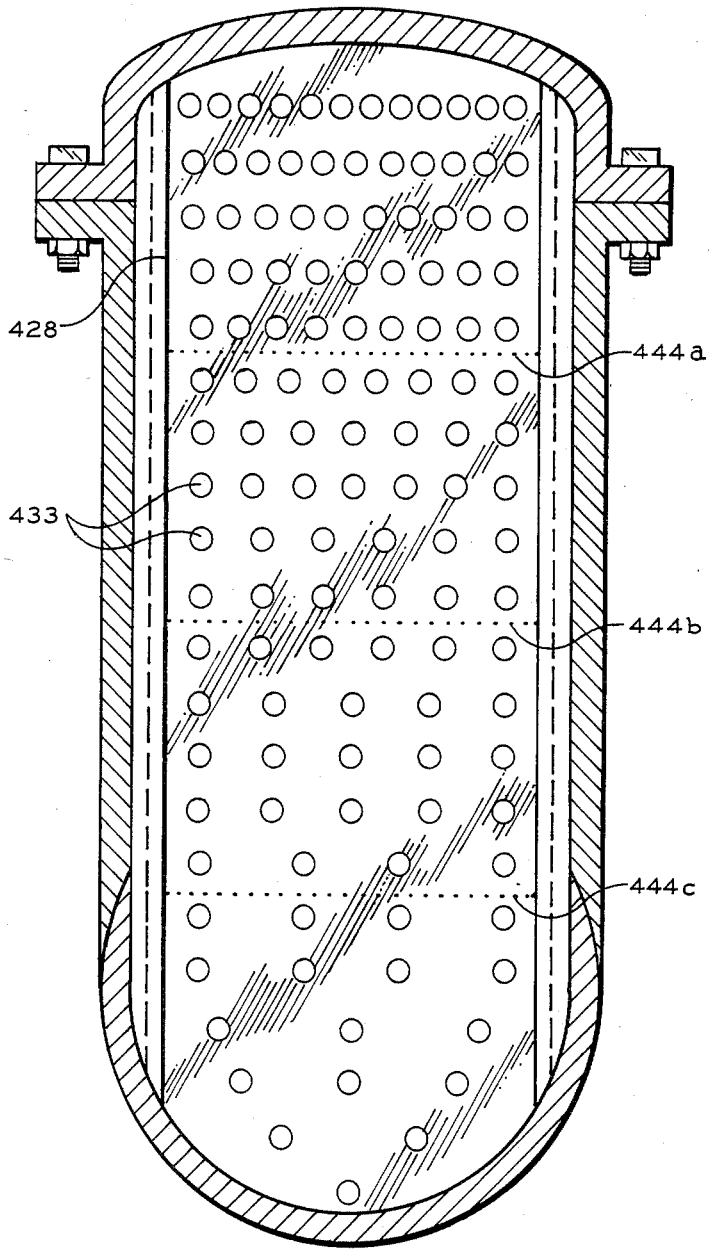
FIG. 4 is a cross-sectional view similar to that of FIG. 3, but of an apparatus in accordance with another embodiment of the invention.

Referring now to FIG. 4, there is shown a cross-sectional view of an apparatus according to another embodiment. This illustrated embodiment is substantially similar to the embodiment of FIG. 3 except for the arrangement and sizing of the apertures. As shown, the apparatus includes plate 428 having apertures such as shown at 433 therethrough. Like the embodiment of FIG. 3, the apertures are arranged and sized such that for a surface of the plate divided into longitudinally separated sections (as bounded, by way of example, by dotted lines 444*a–c*) of approximately equal surface area, each section has associated therewith a certain aperture flow area per unit surface area which for the various sections progressively increases from the lower end of plate 428 to the upper end. However, in the FIG. 4 embodiment, each of the individual apertures 433 has the same flow area, and the number of apertures per section generally progressively increases from the lower end of plate 428 to the upper end. In other words, the apertures 433 are progressively more closely spaced from the lower end of plate 428 to the upper end.

It should be understood that the invention, according to certain broad aspects thereof, is not limited to the particular embodiments shown in FIGS. 3 and 4, nor is the invention limited to the case where aperture flow area per unit surface area generally increases from the lower end of the plate to the upper end of the plate. For example, it is within the scope of the invention to have equally sized and spaced apertures, although such an embodiment is not preferred.

Turning now to the operation of the above-described apparatus, reference will be made to FIG. 1 for this description. Only two flow paths, as indicated by the series of arrows at 48 and 50, are shown for ease of illustration and description. These illustrated flow paths represent the basic types of flow paths a fluid or fluids take in the apparatus.

In the illustrated embodiment, three different fluids are introduced into inlets 30*a–c* as indicated at 52*a–c*. The fluids, because of the longitudinal separation of the inlets 30*a–c*, are accordingly introduced into tubular portion 12 at locations longitudinally separated from one another with respect to longitudinal axis 24. In the environment of a refinery, for example, where a burner in a boiler or furnace may utilize different gaseous fluids from various sources as combustible heating gases, possible gases for mixing in the apparatus of the invention and subsequent combustion of the mixture include gases such as methane, natural gas, ethane, propane and butane. Although the invention is particularly suitable for this type of application which involves mixing of gases, it should be understood that the invention could also be applied to liquids as long as the apparatus is operated and oriented in a manner whereby tubular portion 14 is kept substantially liquid full.

After the fluids are introduced into the apparatus, fluid flow in tubular portion 12 is established in a conventional manner (i.e. by having an appropriate pressure differential across the apparatus) so that fluid flows in upstream chamber 38 in a direction generally parallel to longitudinal axis 24 and toward plate 28. Accordingly, fluid flows adjacent to surface 32*a* so that some fluid passes through apertures positioned within tubular portion 12, as indicated at 48 for example, and then into downstream chamber 40. Other fluid is directed along surface 32*a*, as indicated at 50 for example, so as to flow into tubular portion 14, through apertures positioned within tubular portion 14, and then into downstream chamber 40 so as to be directed by the interior surface of tubular portion 14 back into tubular portion 12.

As previously explained in the Summary of the Invention, operation of the apparatus as above-described effectively mixes a plurality of fluids which are flowed therethrough, and in particular, effectively mixes volumes or slugs of different fluids which are longitudinally separated from one another. This is particularly a problem where the different fluids are introduced into a static mixer at longitudinally separated locations, and where flow rates of the different fluids introduced into the apparatus are unstable so that such flow rates differ widely at times. Effective mixing of different heating gases which are supplied to the burner of a boiler or furnace, for example, is particularly important, as explained previously, since introduction of unmixed slugs of gas to such a burner can cause a potentially hazardous, wildly fluctuating flame. Therefore, in order for the burner to provide steady, uniform heating in this situation, frequent adjustments must be made. These problems are reduced or avoided by the present invention.

Other advantages offered by the present invention include a minimal effect on fluid flow rate and generation of little or no noise. Both of these advantages stem from the fact that less turbulence, as compared to prior Static Mixers, is created in an apparatus operated in accordance with the invention. Although turbulence is minimized in accordance with the invention, a minor amount of turbulence results from flow of fluid through apertures located within tubular portion 14, followed by the change of flow direction caused by tubular portion 14. This enhances the mixing effect. However, the primary mixing effect results from the effect on the flow paths of fluid passing through the inventive apparatus.

Obviously many modifications and variations of the present invention are possible in light of the above teachings. It is therefore understood that within the scope of the appended claims the invention may be practiced otherwise than as specifically described.

That which is claimed is:

1. An apparatus comprising:

a pipe member which includes a first tubular portion and a second tubular portion, each of said portions having respective interior surfaces which together comprise the interior surface of said pipe member, wherein said first portion has a longitudinal axis and a wall with an opening therethrough, and wherein said second portion has a longitudinal axis, an open end, and a closed end axially opposite said open end with respect to said second portion longitudinal axis, said second portion being connected to said first portion wall at said open end so as to outwardly extend from said wall to said closed end and so that said open end is in communication with the interior of said first portion through said opening;

means for introducing a fluid into said first portion so as to establish a flow of fluid in a direction generally parallel to said first portion longitudinal axis and generally toward said second portion longitudinal axis;

a plate having opposing surfaces, a first end, a second end, and a plurality of apertures which open through said surfaces so that some of said apertures are positioned within said first portion whereas the remainder of said apertures are positioned within said second portion, said plate being positioned within said pipe member so as to extend from said first end, which is adjacent to the interior surface of said first portion at a location axially opposite (with respect to said second portion longitudinal axis) said closed end, to said second end which is adjacent to the interior surface of said second portion at said closed end, and wherein said plate extends across said pipe member so as to cross said first portion longitudinal axis, and further wherein one of said plate surfaces faces generally in the same direction as said flow direction and said other plate surface faces generally in a direction opposite to said flow direction.

2. An apparatus as recited in claim 1 wherein said plate has a longitudinal axis which intersects said first and second ends, and where for each said surface of said plate divided into longitudinally separated (with respect to said plate longitudinal axis) sections of approximately equal surface area and where each section includes at least one aperture, each section has associated therewith a certain aperture flow area per unit surface area which for the various sections generally progressively increases from the first end of said plate to the second end of said plate.

3. An apparatus as recited in claim 2 wherein the flow area of individual apertures generally progressively increases from the first end of said plate to the second end of said plate.

4. An apparatus as recited in claim 2 wherein each of said apertures has about the same flow area, the number of apertures per section generally progressively increasing from the first end of said plate to the second end of said plate.

5. An apparatus as recited in claim 2 wherein said second portion longitudinal axis is generally perpendicular to said first portion longitudinal axis, and wherein said plate extends generally along said second portion longitudinal axis.

6. An apparatus as recited in claim 5 wherein said opposing surfaces of said plate are parallel and planar, each of said surfaces being generally perpendicular to said first portion longitudinal axis.

7. An apparatus as recited in claim 6 wherein said plate has an edge which connects said opposing planar surfaces, said edge being in contact with the interior surface of said pipe member around the entire perimeter of said edge surface.

8. An apparatus as recited in claim 7 wherein the total flow area of said plurality of apertures is at least equal to the cross-sectional area of said first tubular portion.

9. An apparatus as recited in claim 8 wherein the ratio of said total flow area to said cross-sectional area of said first tubular portion is about 2:1.

10. An apparatus as recited in claim 8 wherein said closed end of said second portion comprises a removable cap, and further wherein said apparatus further comprises plate receiving means fixedly mounted to the interior surface of said pipe member, said plate receiving means receiving said plate therein so that said plate is removably mounted within said pipe member.

11. An apparatus as recited in claim 10 wherein said plate receiving means comprises a pair of elongated members mounted on opposite sides of said pipe member so as to be oriented generally parallel to said second portion longitudinal axis, each said elongated member defining a channel which removably and slidably receives said plate therein.

12. An apparatus as recited in claim 11 wherein said fluid introducing means introduces a plurality of different fluids into said first tubular portion.

13. An apparatus as recited in claim 12 wherein said fluid introducing means includes a plurality of pipe member inlets which communicate with the interior of said first portion and which are longitudinally separated from one another with respect to said first portion longitudinal axis, and wherein each said inlet corresponds to a particular fluid of said plurality of fluids which is passed therethrough.

14. A method comprising:

passing fluid through a first tubular portion, having a longitudinal axis, in a direction generally parallel to said axis;

flowing said fluid generally toward a plate, having apertures therethrough, which is positioned in said first portion so as to extend into a second tubular portion so as to divide said pipe member into an upstream chamber and a downstream chamber, said second portion being connected to said first portion at an open end of said second portion so that said open end communicates with the interior of said first portion and so that said second portion extends outwardly from said first portion to a closed end, wherein fluid flows adjacent to a surface of said plate which generally faces said upstream chamber so that some of said fluid passes through apertures positioned within said first portion to said downstream chamber, whereas other fluid is directed along said plate surface so as to flow into said second portion and through apertures positioned within said second portion to said downstream chamber to thereby be directed by said second portion back into said first portion.

15. A method as recited in claim 14 wherein a plurality of different fluids are introduced to said first tubular portion so as flow therethrough in said upstream chamber and through said plate apertures to said downstream chamber.

16. A method as recited in claim 15 wherein each of said plurality of fluids are introduced at locations longitudinally separated from one another with respect to the longitudinal axis of said first tubular portion.

17. A method as recited in claim 16 wherein each fluid is selected from the group consisting of methane, natural gas, ethane, propane and butane.

18. A method as recited in claim 17 wherein said second tubular portion has a longitudinal axis generally perpendicular to said first portion longitudinal axis, and wherein said plate has another surface which faces said downstream chamber and also has a first end positioned adjacent to the interior surface of said first tubular portion at a location axially opposite, with respect to said second portion axis, said closed end, and additionally has a second end positioned adjacent to said closed end, further wherein said apertures through which fluid flows are arranged and sized such that for each said surface of said plate divided into longitudinally separated sections of equal surface area and where each section includes at least one aperture, each section has associated therewith a certain aperture flow area per unit surface area which for the various sections generally progressively increases from said first end to said second end.

19. A method as recited in claim 18 wherein the total flow area of said plurality of apertures is at least equal to the cross-sectional flow area of said first tubular portion.

20. A method as recited in claim 19 wherein the ratio of said total flow area to said cross-sectional flow area of said first tubular portion is about 2:1 so as to optimally minimize the effect on flow rate of fluid passing from said upstream chamber to said downstream chamber.

* * * * *